US007416445B1

(12) United States Patent
Brown

(10) Patent No.: US 7,416,445 B1
(45) **Date of Patent: *Aug. 26, 2008**

(54) ELECTRICAL CONNECTOR HOUSING COVER

(75) Inventor: Cecil Brown, Canton, MI (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/004,368

(22) Filed: Dec. 19, 2007

Related U.S. Application Data

(63) Continuation of application No. 11/811,085, filed on Jun. 7, 2007, now Pat. No. 7,354,310.

(51) Int. Cl.
*H01R 13/40* (2006.01)

(52) U.S. Cl. ..... 439/596

(58) Field of Classification Search ..... 439/188, 439/352, 620.05, 467, 713, 596
See application file for complete search history.

(56) References Cited

U.S. PATENT DOCUMENTS

| | | | | |
|---|---|---|---|---|
| 5,616,045 | A | 4/1997 | Gauker | 439/352 |
| 5,746,618 | A | 5/1998 | Gauker | 439/352 |
| 5,860,834 | A | 1/1999 | Sugiyama | 439/595 |
| 6,000,967 | A | 12/1999 | Norizuki et al. | 439/596 |
| 6,165,012 | A * | 12/2000 | Abe et al. | 439/596 |
| 6,176,740 | B1 | 1/2001 | Abe et al. | 439/596 |
| 6,364,683 | B1 | 4/2002 | Kohno | 439/352 |
| 6,443,767 | B1 | 9/2002 | Nagai | 439/596 |
| 6,663,411 | B2 | 12/2003 | Little | 439/352 |
| 6,799,999 | B2 | 10/2004 | Williamson et al. | 439/676 |
| 6,997,750 | B2 | 2/2006 | Johannes et al. | 439/620 |
| 2002/0009924 | A1 | 1/2002 | Little et al. | 439/625 |
| 2006/0084314 | A1 | 4/2006 | Takizawa | 439/352 |

FOREIGN PATENT DOCUMENTS

| | | | |
|---|---|---|---|
| EP | 1 150 389 | A1 | 4/2001 |
| GB | 2 138 639 | A | 10/1984 |
| WO | WO-2005/112201 | A1 | 11/2005 |
| WO | WO-2005/112201 | A1 | 11/2005 |

OTHER PUBLICATIONS

Drawing, "1.0 mm NWP System IFK Connector", Yazaki Corp., 1 page, Feb. 24, 2005.
Drawing, "1.0 mm NWP System IFK Connector", Yazaki Corp., 1 page, Feb. 8, 2005.

* cited by examiner

*Primary Examiner*—Tho D Ta
(74) *Attorney, Agent, or Firm*—Harrington & Smith, PC

(57) ABSTRACT

An electrical connector housing including a base; and a cover. The cover is adapted to be connected to the base to capture at least one electrical connector component in the base. The cover includes a first section and a second section. The second section is movably connected to the first section by a connection. The second section is movable between an open position relative to the base and a closed position. The connection includes a detent latching system for latching the second section in the open position to allow access to a location inside the base.

20 Claims, 11 Drawing Sheets

ELECTRICAL CONNECTOR HOUSING COVER

CROSS-REFERENCE TO RELATED APPLICATION

This is a continuation patent application of U.S. patent application Ser. No. 11/811,085 filed Jun. 7, 2007, now U.S. Pat. No. 7,354,310.

BACKGROUND OF THE INVENTION

1. Field of the Invention

The invention relates to an electrical connector and, more particularly, to an electrical connector housing cover.

2. Brief Description of Prior Developments

Electrical connectors such as squib connectors or air bag gas generator connectors are well known in the art. Some electrical connectors, such as shown in U.S. Pat. Nos. 5,616,045 and 6,663,411 B2, have housings with movable cover sections. In U.S. Pat. No. 6,663,411 B2 the housing and the cover have sections attached by living hinges which can be moved to allow crimping of electrical contacts onto conductors.

There is a desire to be able to provide an electrical connector which is substantially pre-assembled except for connection of its contacts with conductors. U.S. Pat. No. 6,663,411 B2 shows one such electrical connector. However, the connection of the movable housing and cover sections merely by living hinges does not prevent the housing and/or cover section from moving into the area where crimping of the contacts will occur. This might damage the housing and/or cover section or interfere with proper crimping. There is a desire to provide an electrical connector having a housing which allows for crimping of the contacts inside the housing, and which is subsequently closed, but which is a substantially complete assembly before crimping.

SUMMARY OF THE INVENTION

In accordance with one aspect of the invention, an electrical connector housing is provided including a base; and a cover. The cover is adapted to be connected to the base to capture at least one electrical connector component in the base. The cover includes a first section and a second section. The second section is movably connected to the first section by a connection. The second section is movable between an open position relative to the base and a closed position. The connection includes a detent latching system for latching the second section in the open position to allow access to a location inside the base.

In accordance with another aspect of the invention, an electrical connector housing is provide comprising a base and a cover. The base has contact receiving areas and at least one aperture through a bottom side of the base into the contact receiving areas. The cover is adapted to be connected to a top side of the base to capture at least one electrical connector component in the base. The cover comprises a first member and a second member. The second member is pivotably connected to the first member by a connection. The second member is movable between an open position relative to the base and a closed position. The connection comprises a latching system for latching the second member in the open position to allow access to a location inside the base.

In accordance with another aspect of the invention, a method of assembling an electrical connector comprising providing an electrical connector comprising an electrical connector housing comprising a base having contact receiving areas and at least one aperture through a bottom side of the base into the contact receiving areas; and a cover connected to a top side of the base to capture at least one electrical contact in the base, wherein the cover comprises a first member and a second member, wherein the second member is pivotably connected to the first member by a connection, wherein the second member is movable between an open position relative to the base and a closed position, wherein the connection comprises a latching system for latching the second member in the open position to allow access to a location inside the base; locating the second member at the open position; crimping the at least one electrical contact onto at least one electrical conductor through the aperture in the bottom side of the base and an open area at the top side of the base into the location; and moving the second member to the closed position to close the open area at the top side of the base.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
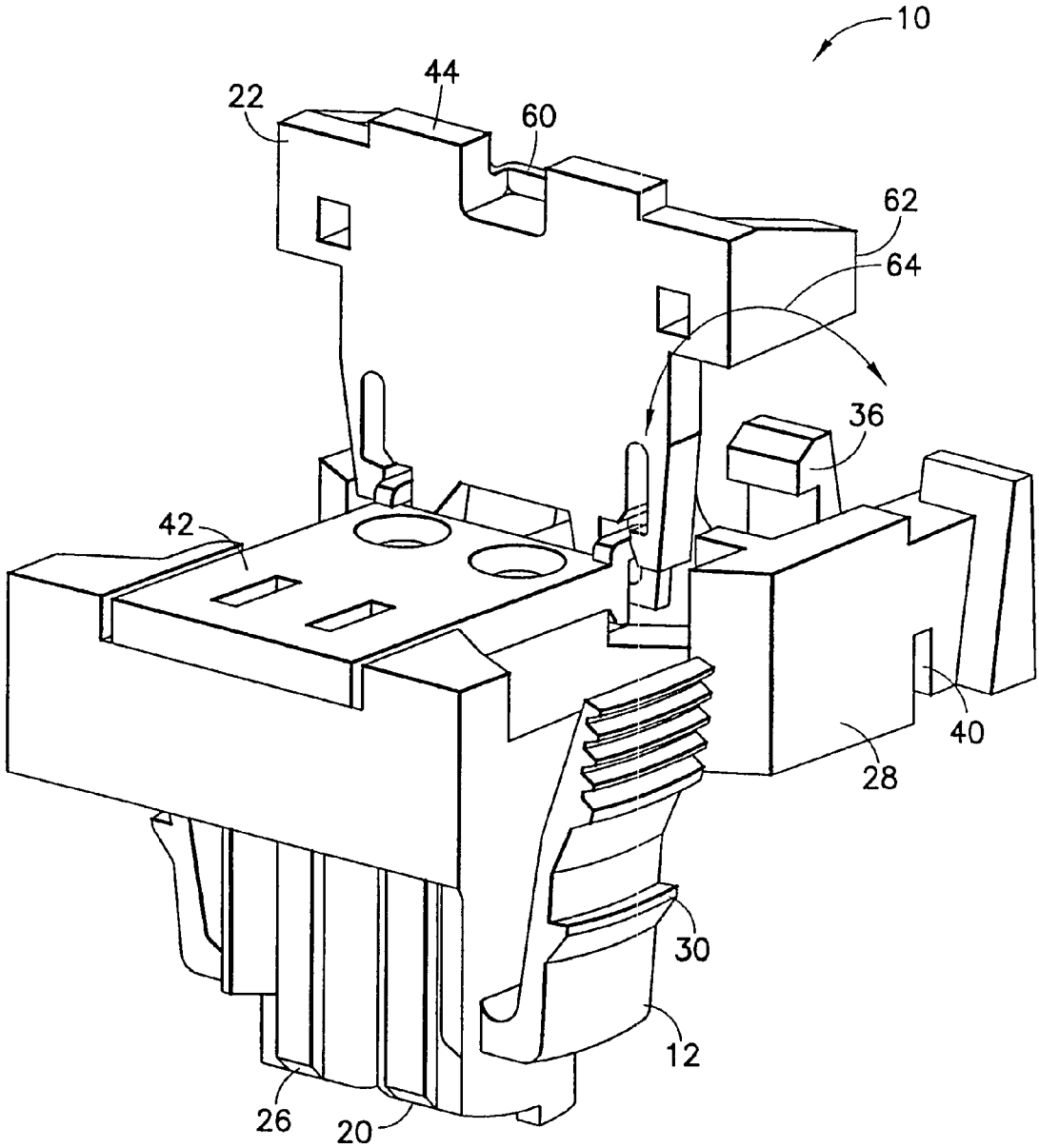
FIG. 1 is a perspective view of an electrical connector comprising features of the invention with a cover section in an open position.
Figure 2:
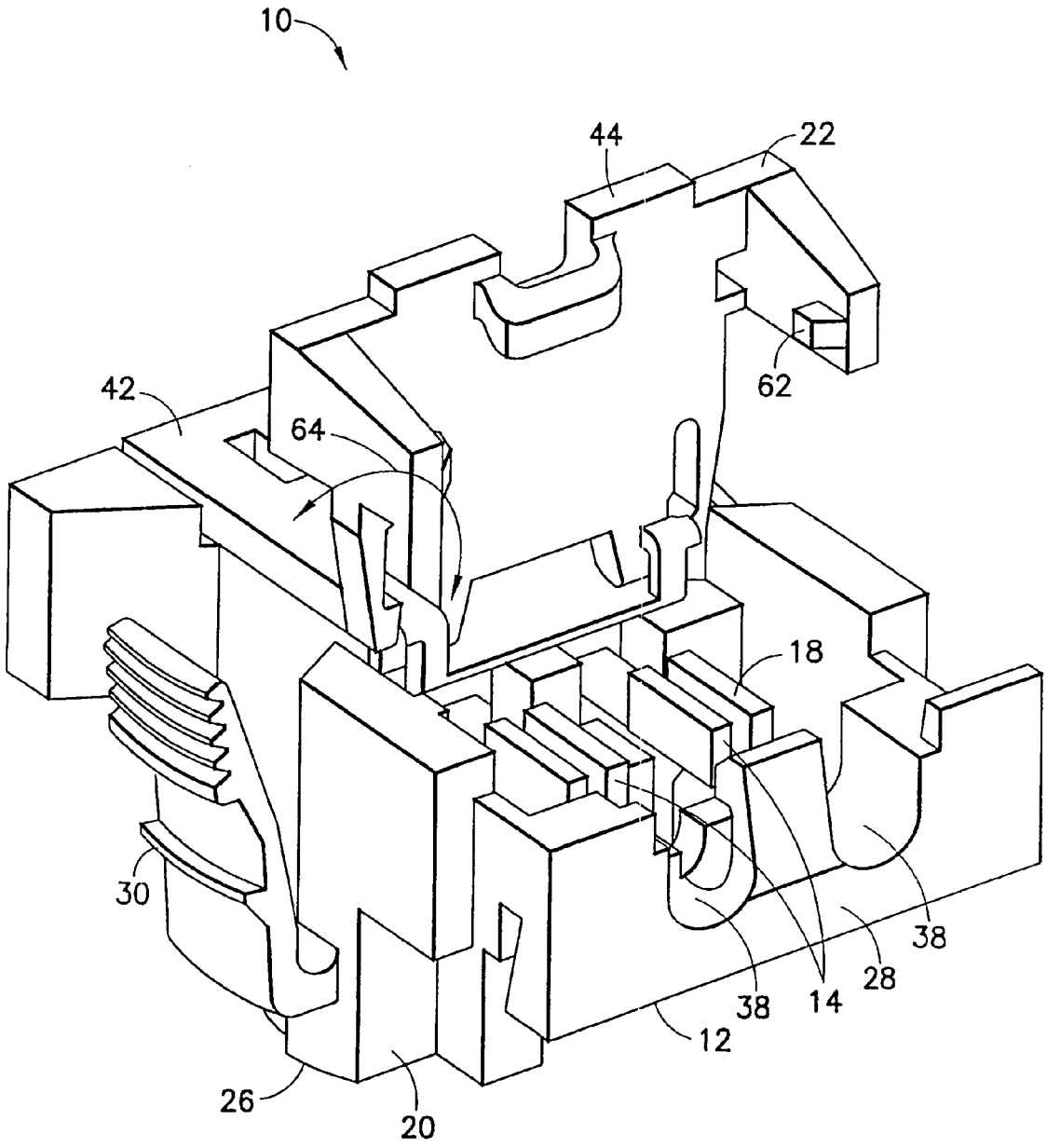
FIG. 2 is a perspective view of the electrical connector shown in FIG. 1 from a different direction.

Referring to FIGS. 1 and 2, there are shown perspective views of an electrical connector 10 incorporating features of the invention. Although the invention will be described with reference to the exemplary embodiment shown in the drawings, it should be understood that the invention can be embodied in many alternate forms of embodiments. In addition, any suitable size, shape or type of elements or materials could be used.

Figure 3:
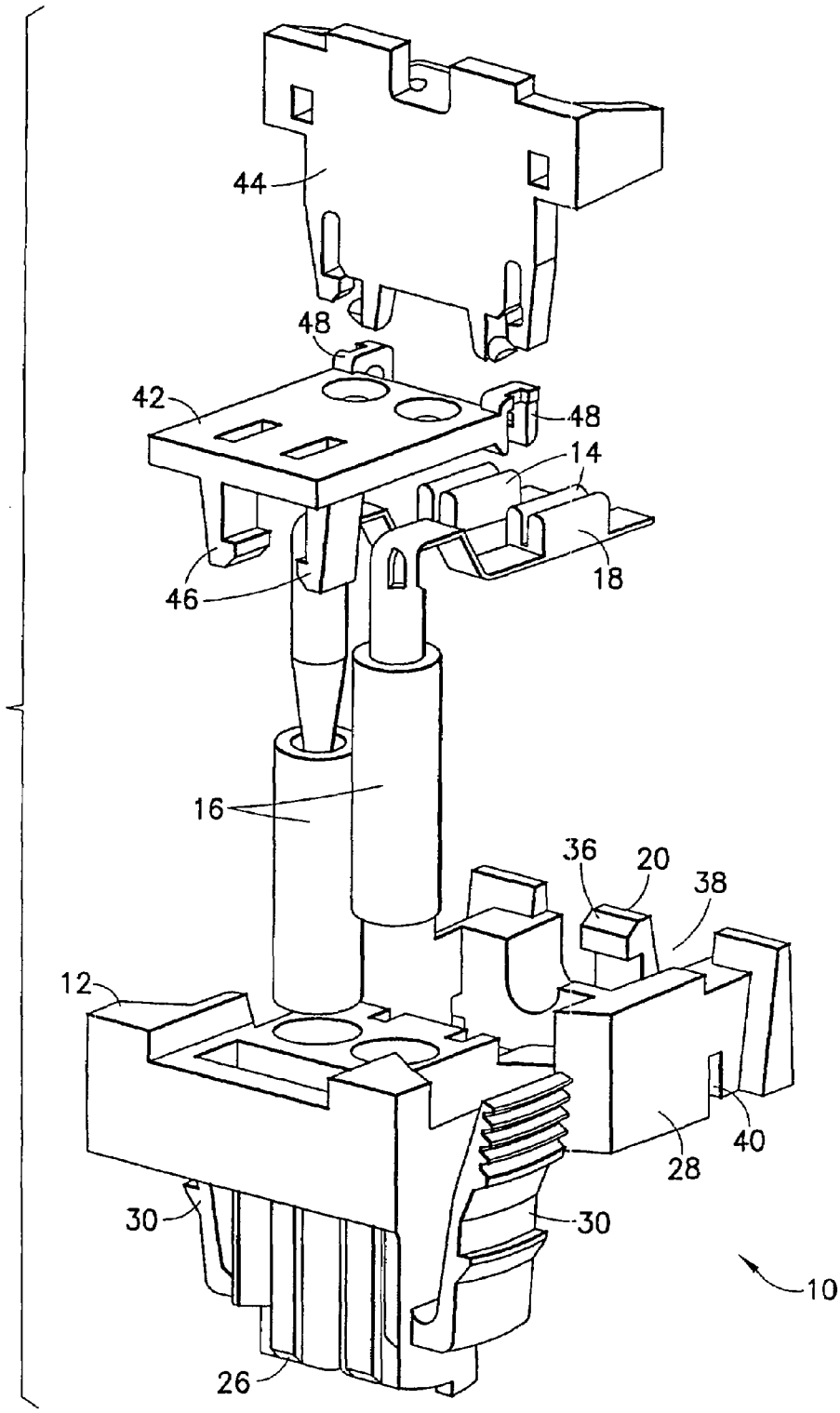
FIG. 3 is an exploded perspective view of the connector shown in FIG. 1.
Figure 4:
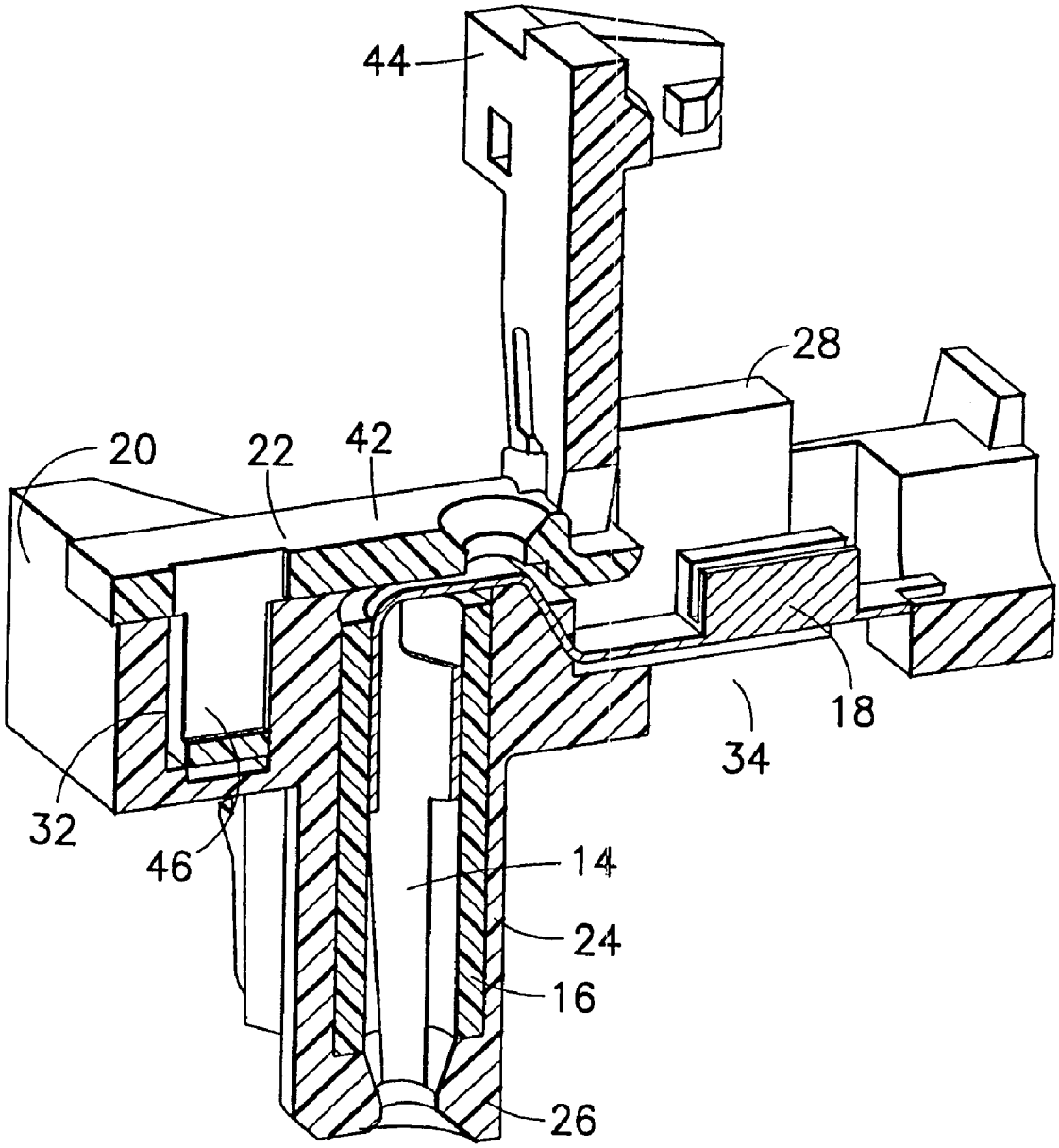
FIG. 4 is a perspective cross sectional view of the connector shown in FIG. 1.
Figure 5:
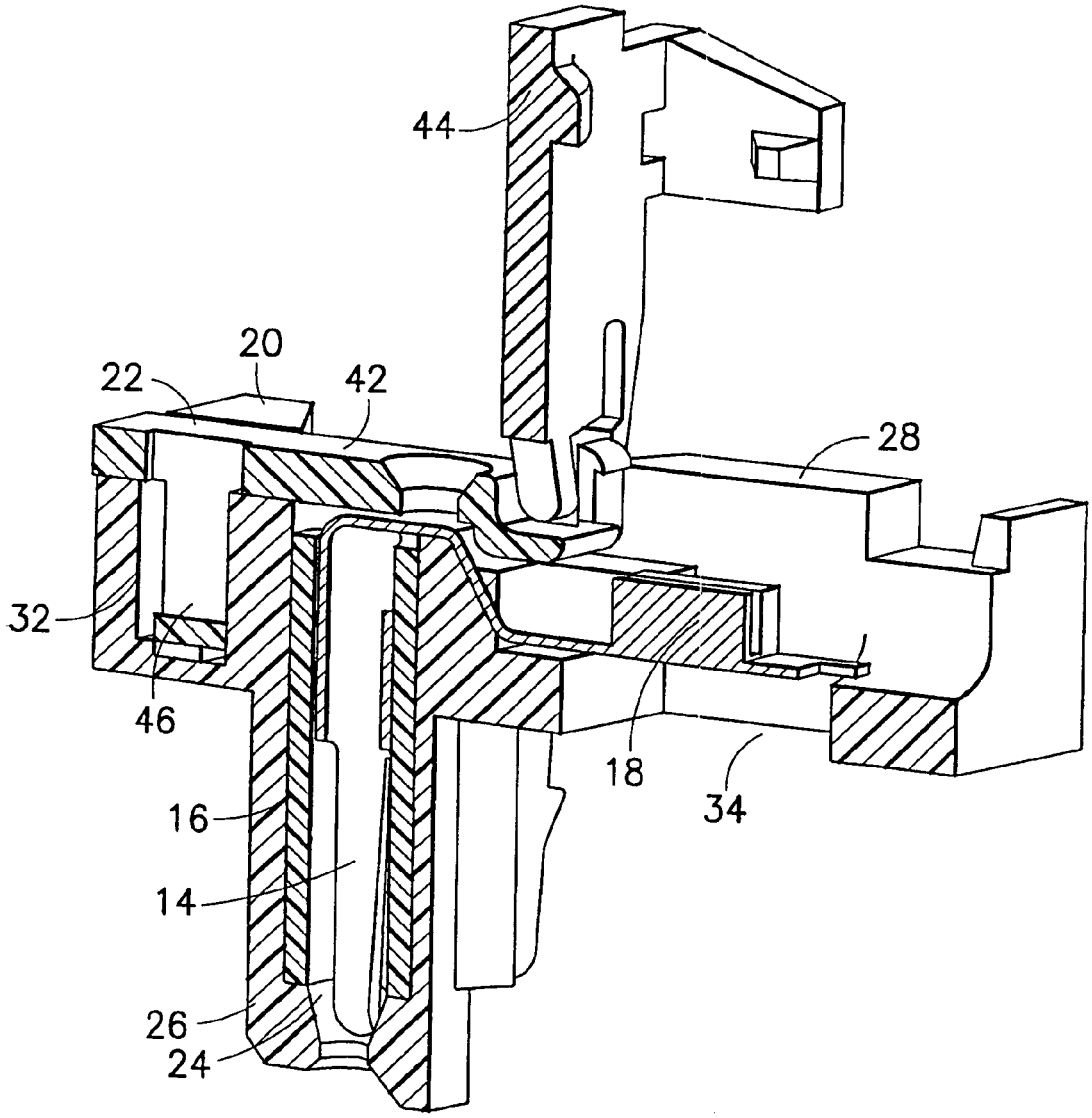
FIG. 5 is a perspective cross sectional view of the connector shown in FIG. 4 from a different direction.
Figure 6:
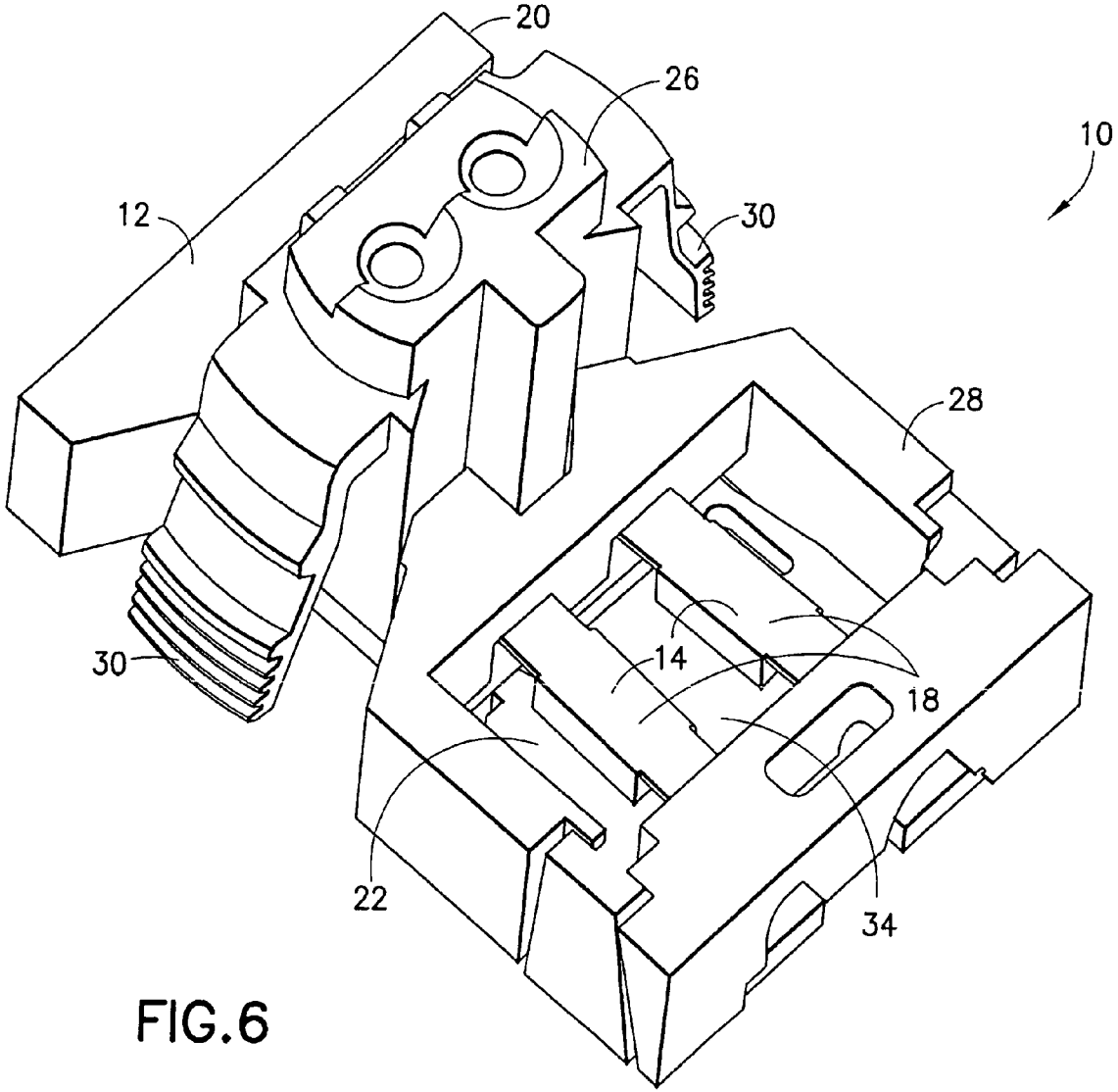
FIG. 6 is a perspective view of the connector shown in FIG. 1 from a different direction with the cover section closed.
Figure 7:
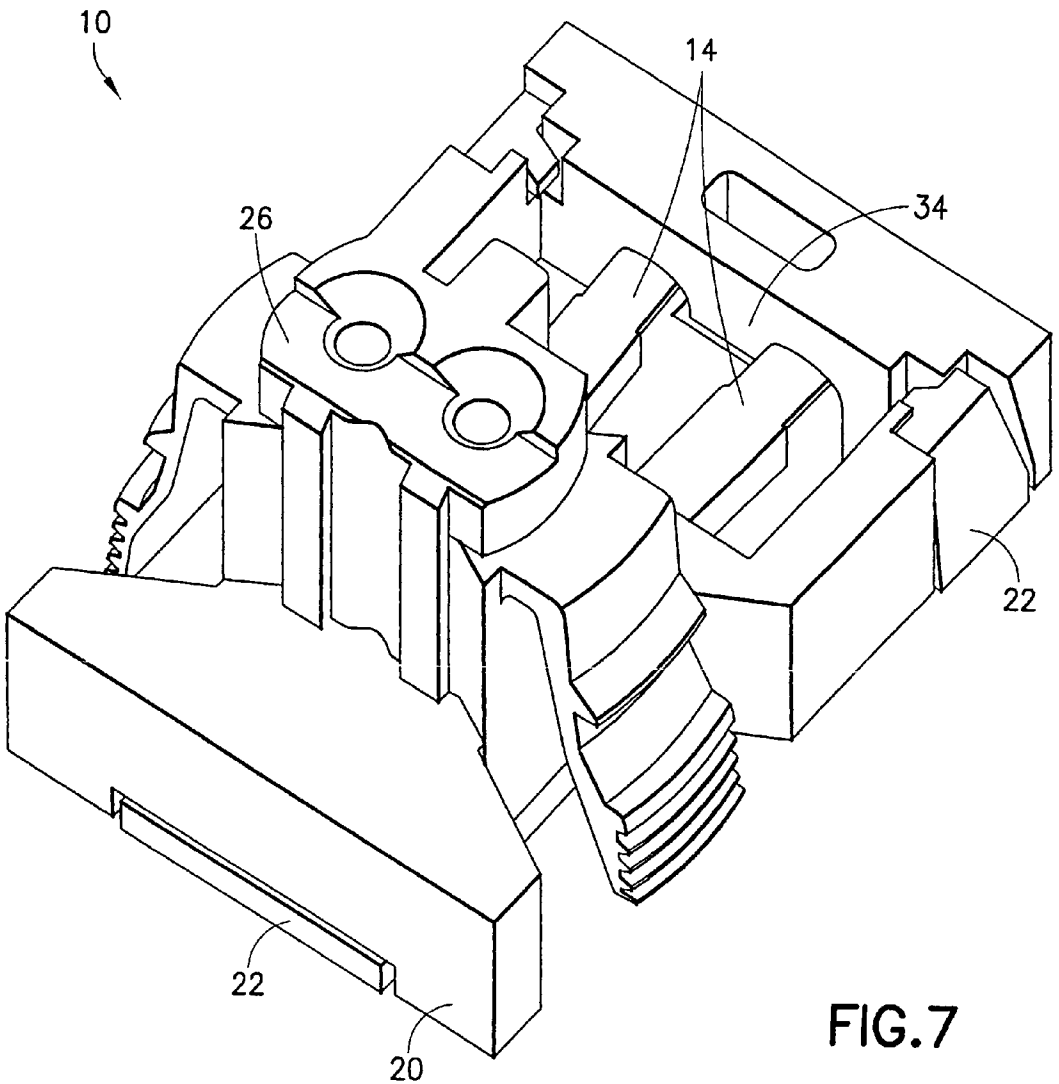
FIG. 7 is a perspective view of the connector shown in FIG. 7 from a different direction.

The connector 10 is shown prior to its connection to conductor wires. In this embodiment the connector 10 is a squib connector adapted to connect the conductor wires to a mating electrical connector in a gas generator of a vehicle air bag safety system. However, features of the invention could be used with any suitable type of electrical connector. Similar connectors are shown in U.S. Pat. Nos. 6,799,999 B2 and 6,997,750 which are hereby incorporated by reference in their entireties. Referring also to FIG. 3, the connector 10 generally comprises a housing 12, electrical contacts 14 and filters 16. In alternate embodiments, the connector could comprise additional or alternative members. The connector 10 is a right angle connector. However, features of the invention could be used in an in-line straight connector.

The contacts 14 are conventional electrical contacts such as those described in U.S. Pat. Nos. 6,799,999 B2 and 6,997,750 for example. The contacts have a front end adapted to receive a male contact section of a mating electrical connector. The contacts 14 also each have a rear end 18 which is adapted to be crimped onto an electrical wire. In alternate embodiments, any suitable type of contacts could be provided.

The filters 16 comprise ferrite tubes which are mounted on the front ends of the contacts 14. In alternate embodiments, any suitable type of filter(s) could be used including a single filter which mounts on both contacts, or a filter chip assembly such as disclosed in U.S. Pat. No. 6,997,750 for example. In one type of alternate embodiment, the connector might not comprise a filter.

Referring also to FIGS. 4-7, the housing 12 generally comprises a base 20 and a cover 22. The base 20 comprises a one-piece member made of molded plastic or polymer material. The base 20 includes two contact receiving areas 24 which extend through a front plug section 26 and a rear wire termination section 28. The front plug section 26 is sized and shaped to be plugged into the mating electrical connector. The front plug section 26 has snap-lock latches 30 to latch with the mating electrical connector. The front plug section 26 and the rear wire termination section 28 are substantially open at the top side of the base 20 to allow the filters 16 and contacts 14 to be top side loaded into the base, and then the cover 22 is connected to lock the filters 16 and contacts 14 in the housing. The front plug section 26 has snap lock recesses 32 (seen best in FIGS. 4 and 5) in its top side for receiving snap-lock latches of the cover 22.

The rear wire termination section 28 has a bottom side with an aperture 34 into the two contact receiving areas. Thus, the rear wire termination section 28 of the base has both an open top side and an aperture through its bottom side. In an alternate embodiment the bottom side of the rear wire termination section 28 might have more or less than one aperture 34. The rear end of the rear wire termination section 28 also has a snap-lock latch 36, grooves 38 for the wires to pass through, and lateral side grooves with latching surfaces 40.

Figure 8:
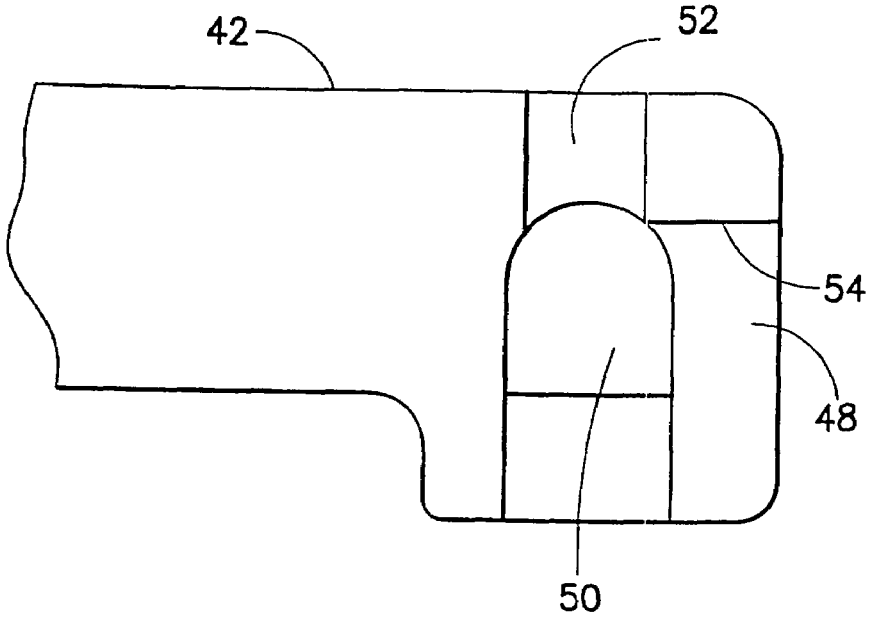
FIG. 8 is a partial side view of the rear end of the front cover section shown in FIGS. 1-7.
Figure 9:
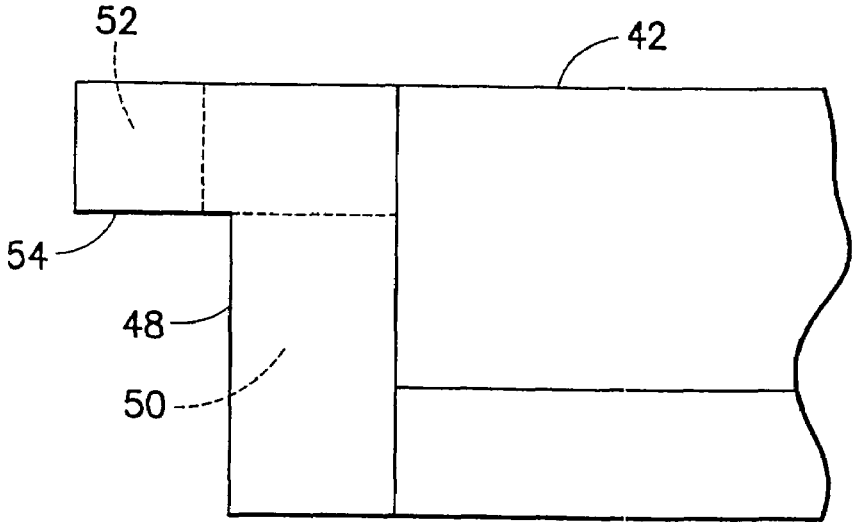
FIG. 9 is a partial rear end view of the front cover section shown in FIG. 8.

The cover 22 comprises a first section 42 and a second section 44. The second section 44 is movably connected to the first section 42 by a movable connection. In this embodiment the first and second sections are separate members which are attached to each other. However, in alternate embodiments, the first and second sections could be a single member, but movable relative to each other. The first section 42 is snap-lock connected to the top end of the front plug section 26 to capture the contacts 14 and filters 16 in the contact receiving areas at the front plug section 26. The first section 42 has snap-lock latches 46 which are able to snap into the snap lock recesses 32. Referring also to FIGS. 8 and 9, the rear end of the first section 42 has pivot mounts 48 at its lateral sides. The pivot mounts 48 have pivot holes 50 therethrough. The outside surfaces of the pivot mounts 48 have a top latch recess 52 and a rear latch surface 54.

Figure 10:
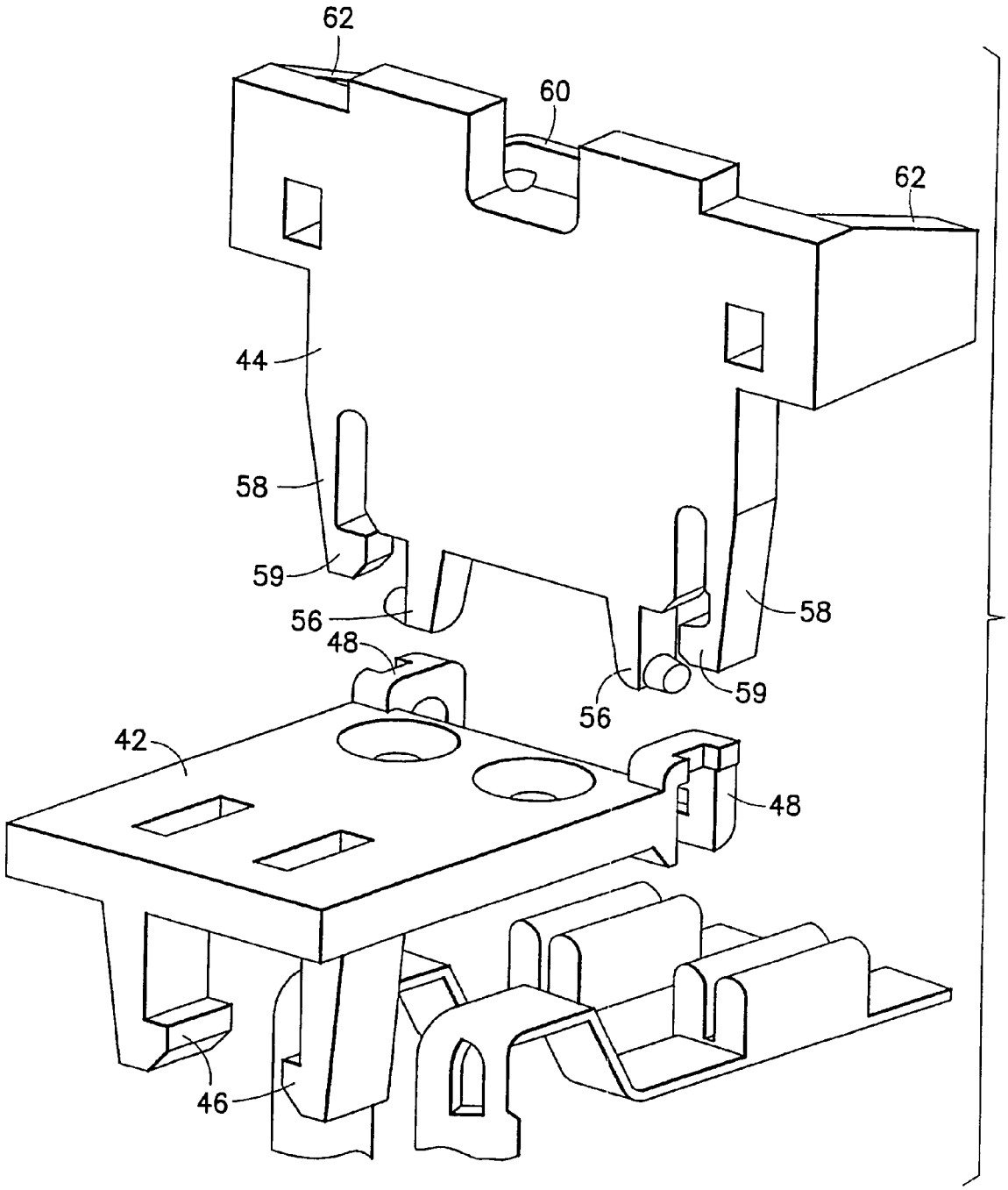
FIG. 10 is an enlarged exploded perspective view of the cover as shown in FIG. 3.

Referring also to FIG. 10, the second section 44 has a front end with pivot posts 56 and latching arms 58, and a rear end with latching surface 60 and two lateral side snap-lock latches 62. The pivot posts 56 are located at outward lateral sides of deflectable arms for mounting into the pivot holes 50 from between the two pivot mounts 48. This rotatably mounts the second section 44 to the first section 42 between an open position as shown in FIGS. 1, 2, 4 and 5, and a closed position as shown in FIGS. 6, 7, 11 and 12. The latching arms 58 have inward projecting detent projections 59. In the open position, detent projections 59 of the latching arms 58 project into the top latch recesses 52. This latches the second section 44 in the open position on the first section and the base. A user can rotate the second section 44 to the closed position as indicated by arrow 64 in FIGS. 1 and 2. The latching arms 58 can resiliently deflect outward with the detent projections of the latching arms 58 moving rearward out of the top latch recesses 52. As the second section 44 reaches the closed position, the detent projections 59 of the latching arms 58 can move beneath the latching surfaces 60 and deflect back to their home positions.

Figure 11:
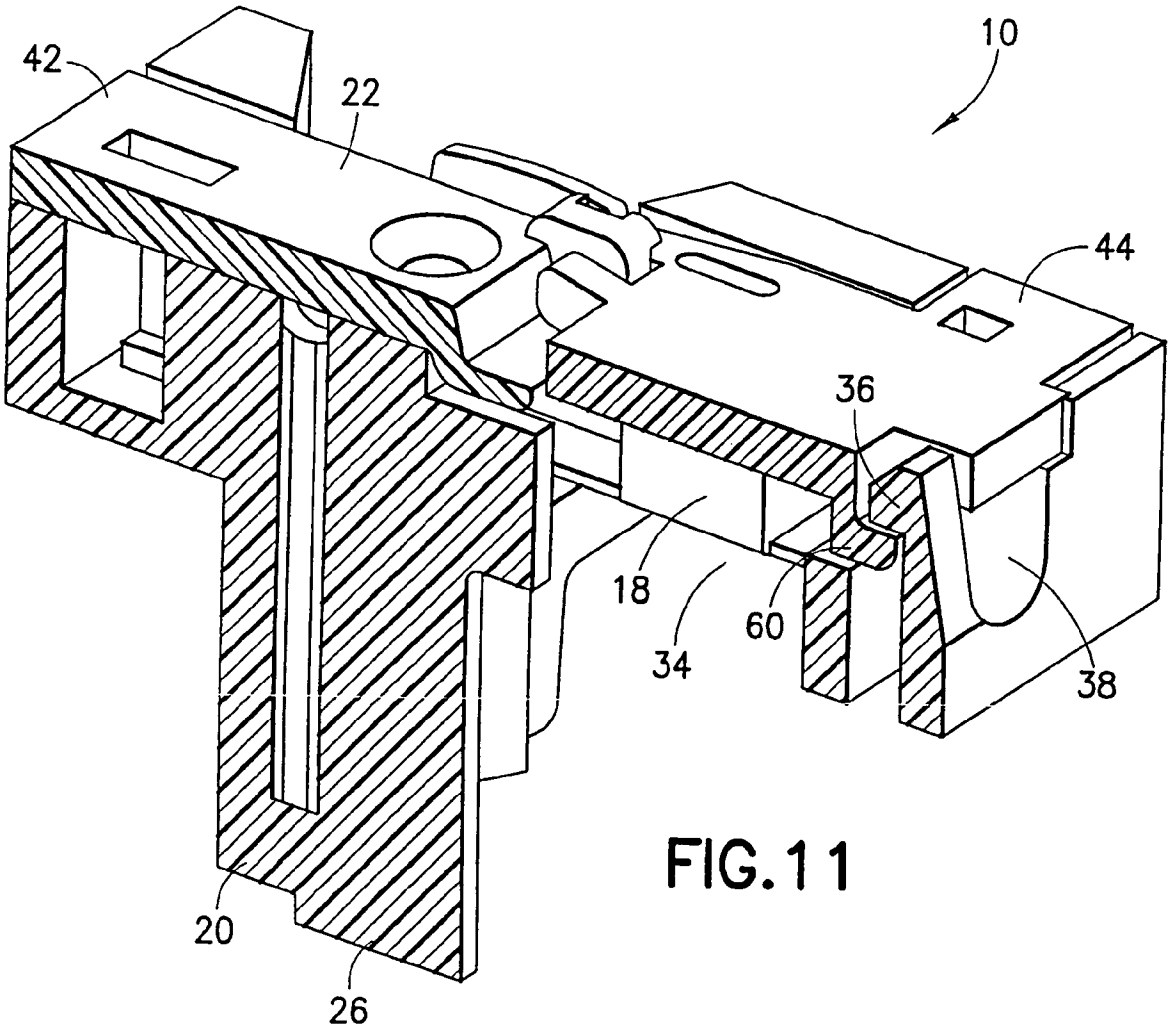
FIG. 11 is a perspective cross sectional view of the connector shown in FIG. 1 with the cover in a closed position.
Figure 12:
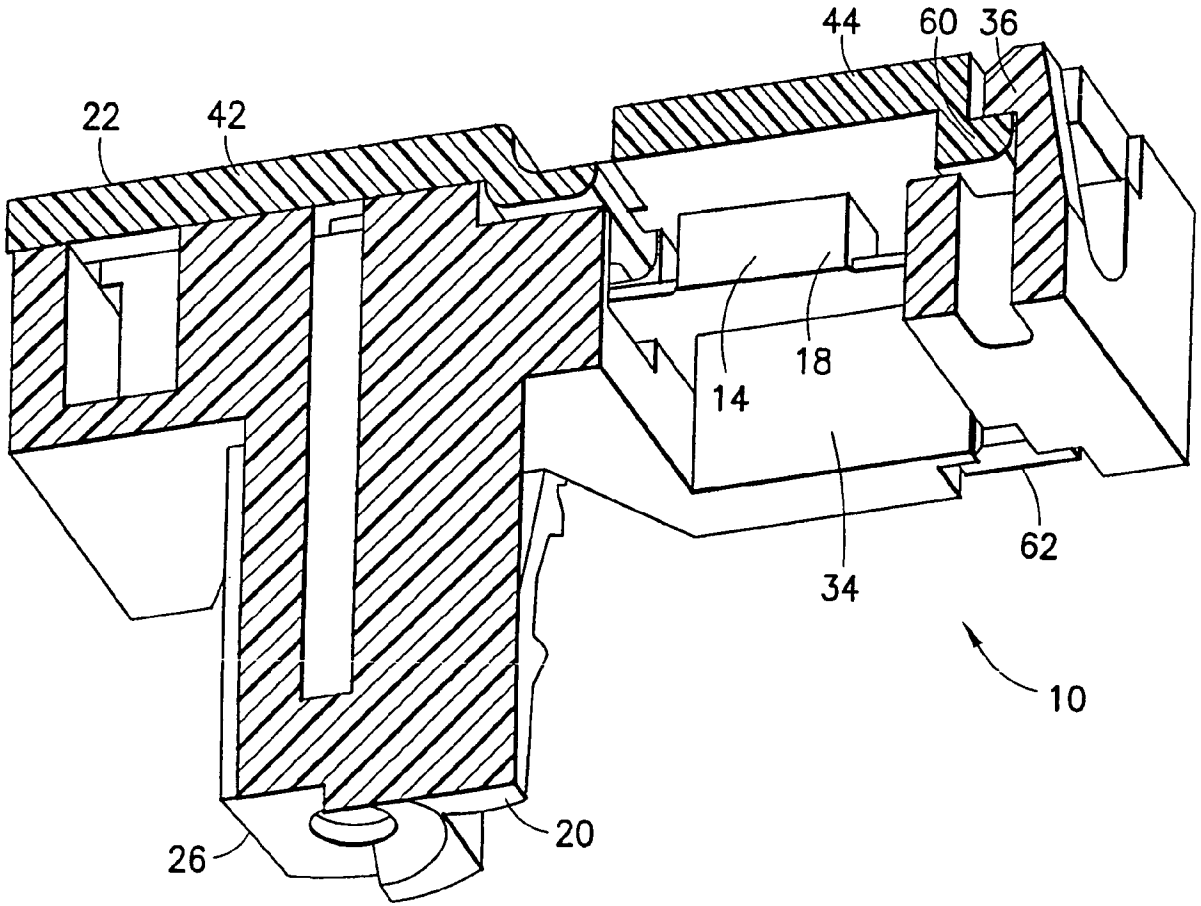
FIG. 12 is a perspective cross sectional view of the connector shown in FIG. 11 from a different direction.

Referring also to FIGS. 11 and 12, when the second section 44 reaches the close position, the latch 36 can snap onto the rear latch surface 60 and the snap-lock latches 62 can latch onto the lateral side latching surfaces 40. Thus, in the closed position, the second section 44 can cover the open top of the rear wire termination section 28 of the base 20.

One of the features of the invention is the ability to retain the second section 44 in the open position by the detent latching system 58, 52. This allows the wires to be crimped onto the contacts 14 at the rear ends 18 while the contacts are inside the housing 12, and insuring that the second section 44 will not interfere with the crimping operation or be damaged during the crimping operation. After the wires are crimped to the contacts, the second section 44 can be moved to its closed position to cover over the crimped connection. The open aperture 34 at the bottom of the base's wire termination section 28 allows access to the crimping area by a bottom section of the crimping tool from the opposite direction. The open top side of the wire termination section 28 allows access to the crimping area by a top section of the crimping tool while the second section 44 of the cover 22 is open. When the connector 10 is connected to the mating electrical connector, the aperture 34 can be at least partially covered or closed by the presence of the mating connector at the aperture 34.

During manufacture of the connector housing, the second section 44 can be snapped into the first section 42. This allows the two sections 42, 44 to be made from different tools and/or different materials. The second section 44 can be locked in the open position by its flexible beams 58 for easier handling during connection to the wires.

In an alternate embodiment, features of the invention could be used with a cover having a living hinge. As another alternate embodiment features of the invention could be used with a cover having a slidable connection between sections of the cover.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An air bag electrical connector housing comprising:

a base comprising a plug section adapted to be plugged into a mating electrical connector, wherein the base comprises contact receiving areas adapted to house electrical contacts; and a cover adapted to be connected to the base to capture the electrical contacts in the base for subsequent connection to the mating electrical connector, wherein the cover comprises a first section and a second section, wherein the second section is movably connected to the first section by a connection, wherein the second section is movable between an open position relative to the base and a closed position, wherein the connection comprises a detent latching system for latching the second section in the open position to allow access to a location inside the base.

2. An air bag electrical connector housing as in claim 1 wherein the connection comprises a pivot connection.

3. An air bag electrical connector housing as in claim 1 wherein the first and second sections are separate members comprised of different materials.

4. An air bag electrical connector housing as in claim 1 wherein the second section is adapted to snap-lock connect with the base in the closed position.

5. An air bag electrical connector housing as in claim 1 wherein the base comprises at least one aperture through a bottom side of the base into the location, wherein the base and cover are sized and shaped to allow portions of contacts to be crimped in the location through the at least one aperture and from above the location when the second section is at the open position.

6. An air bag electrical connector housing as in claim 1 wherein the first section is adapted to snap-lock connect to the base to capture the at least one electrical connector component in the base regardless of the position of the second section.

7. An air bag electrical connector housing as in claim 1 wherein the first and second sections are distinct separate members.

8. An air bag electrical connector housing as in claim 1 wherein the base comprises at least one aperture through a bottom side of the base into the contact receiving areas.

9. An air bag electrical connector housing as in claim 8 wherein the at least one aperture is adapted to be covered, least partially, by the mating electrical connector.

10. A squib electrical connector comprising:

an air bag electrical connector housing as in claim 1; and at least two electrical contacts mounted in the base of the electrical connector housing.

11. A squib electrical connector as in claim 10 further comprising at least one ferrite member mounted on the at least two electrical contacts.

12. An air bag squib electrical connector comprising:

electrical contacts; and a housing having the electrical contacts therein, wherein the housing comprises:

a base having contact receiving areas, wherein the electrical contacts are located in the contact receiving areas, and wherein the base further comprises at least one aperture through a bottom side of the base into the contact receiving areas; and a cover connected to a top side of the base to capture the electrical contacts in the base for subsequent connection to a mating electrical connector, wherein the cover comprises a first member and a separate second member, wherein the second member is pivotably connected to the first member by a connection, wherein the second member is movable between an open position relative to the base and a closed position, wherein the connection comprises a latching system for latching the second member in the open position to allow access to a location inside the base.

13. An air bag squib electrical connector as in claim 12 wherein the base comprises a plug section adapted to be plugged into the mating electrical connector.

14. An air bag squib electrical connector as in claim 12 wherein the latching system comprises a detent latch system.

15. An air bag squib electrical connector as in claim 12 wherein the first and second members are comprised of different materials.

16. An air bag squib electrical connector as in claim 12 wherein the second member is adapted to snap-lock connect with the base in the closed position.

17. An air bag squib electrical connector as in claim 12 wherein the base and cover are sized and shaped to allow portions of the electrical contacts to be crimped in the location through the at least one aperture and from above the location when the second member is at the open position.

18. An air bag squib electrical connector as in claim 12 wherein the first member is adapted to snap-lock connect to the base to capture the electrical contacts in the base regardless of the position of the second member.

19. An air bag squib electrical connector as in claim 12 further comprising at least one ferrite member mounted on the electrical contacts.

20. A method of assembling an air bag squib electrical connector comprising:

providing an electrical connector housing base, wherein the base comprises contact receiving areas and at least one aperture through a bottom side of the base into the contact receiving areas;

inserting electrical contacts into the base; and connecting a cover to the base to capture the electrical contacts in the base, wherein the cover comprises a first member and a distinct separate second member, wherein the second member is pivotably connected to the first member by a connection, wherein the second member is movable between an open position relative to the base and a closed position, wherein the connection comprises a latching system for latching the second member in the open position to allow access to a location inside the base.

* * * * *